US007234781B2

(12) United States Patent
Liao

(10) Patent No.: US 7,234,781 B2
(45) Date of Patent: Jun. 26, 2007

(54) ANCHORING FIXTURE FOR STOOLS CAPABLE OF ADJUSTING ELEVATION

(76) Inventor: Tsun-Chi Liao, 1F, No. 7, Lane 545, Sec. 2, Jyungong Rd., Beitun Dist., Taichung City (TW)

( * ) Notice: Subject to any disclaimer, the term of this patent is extended or adjusted under 35 U.S.C. 154(b) by 158 days.

(21) Appl. No.: 11/182,797

(22) Filed: Jul. 18, 2005

(65) Prior Publication Data

US 2007/0012848 A1 Jan. 18, 2007

(51) Int. Cl.
*A47C 9/00* (2006.01)
*A47C 25/00* (2006.01)

(52) U.S. Cl. ..... 297/461; 297/423.1; 297/344.12; 297/344.21; 248/425; 248/157; 248/163.1; 248/188.4; 248/188.5; 248/186.1; 403/311; 403/312; 403/344

(58) Field of Classification Search ..... 248/425, 248/157, 163.1, 188.4, 188.5, 186.1; 297/344.21, 297/344.12, 423.1, 461; 403/344, 311, 312
See application file for complete search history.

(56) References Cited

U.S. PATENT DOCUMENTS 5,681,126 A * 10/1997 Lin ..... 403/313
5,722,627 A * 3/1998 Hoshino ..... 248/405
5,738,326 A * 4/1998 Liao ..... 248/405
5,816,556 A * 10/1998 Liao ..... 248/405
5,842,742 A * 12/1998 Hoshino ..... 297/338
5,927,810 A * 7/1999 Liao ..... 297/344.12
6,030,045 A * 2/2000 Hoshino ..... 297/461
6,155,743 A * 12/2000 Chen ..... 403/374.1
6,557,878 B2 * 5/2003 Chen ..... 280/226.1
6,672,660 B2 * 1/2004 Hoshino ..... 297/195.1

* cited by examiner

*Primary Examiner*—Carl D. Friedman
*Assistant Examiner*—Nkeisha Dumas
(74) *Attorney, Agent, or Firm*—Birch, Stewart, Kolasch & Birch, LLP

(57) ABSTRACT

An anchoring fixture for stools capable of adjusting elevation is installed on an axle hub hinged on the top end of tripod legs which rest on the floor. The axle hub has a longitudinal axle hole to hold a screw post fastened to the bottom of a stool. The axle hub has a hinge portion on one side of the top surface. The hinge portion has lugs on two sides to be coupled with one end of two clamping members. The clamping members have another end to be fastened by a fastening element. The hinge portion and the two clamping members have respectively a thread portion which jointly mates and couples with the screw post beneath the stool. Thus the elevation of the stool may be rapidly adjusted upwards and downwards to clamp the screw post tightly.

6 Claims, 6 Drawing Sheets

ANCHORING FIXTURE FOR STOOLS CAPABLE OF ADJUSTING ELEVATION

FIELD OF THE INVENTION

The present invention relates to a structure for adjusting the elevation of stools and particularly to an anchoring fixture which provides a clamping force and also offers rapid elevation adjustment of the stools.

BACKGROUND OF THE INVENTION

The conventional stool with adjustable elevation, especially the one for a drummer to sit as shown in FIGS. 1 and 2, mainly includes a tripod 1 which has a top to pivotally couple the peripheral wall of a center post 2. The center post 2 has a screw hole 3 on an upper portion and a top end to couple with a coupling head 4. The coupling head 4 has a screw bore 5 in the center to hold a screw bar 6 on a lower side of a stool. The internal diameter of one end of the screw bore 5 coupling with the center post 2 is greater than that of the other end of the screw bore 5 coupling with the screw bar 6. The coupling head 4 can couple on the outer peripheral wall of the upper portion of the center post 2. The screw bar 6 can be engaged with the screw hole 3 of the center post 2 and held in the hollow interior of the center post 2. A pressing screw rod 7 is provided to fasten transversely on the coupling head 4 through the peripheral wall with a front end to compress the outer wall of the center post 2. When the drummer sits on the stool to strike the drums and other musical instruments, the sitting elevation should allow the drummer to swivel the body quickly and move two hands at desirable angles to do striking operations. As the physical size of the drummer varies greatly, the elevation of the stool has to be adjusted as desired. To do adjustment, first, loosen the pressing screw bar 7; next swivel the stool to rotate the screw bar 6 below the stool so that the screw bar 6 coupled with the screw hole 3 of the center post 2 is moved downwards (or upwards). When to move the stool upwards or downwards for a greater distance, the stool has to be swiveled many times. The adjustment speed is slow. Swiveling the stool in the wrong direction frequently occurs and causes troubles. There is still room for improvements.

SUMMARY OF THE INVENTION

In view of the aforesaid problems, the primary object of the present invention is to provide an anchoring fixture for stools capable of adjusting elevation. The invention is installed on an axle hub pivotally coupled on the top end of tripod legs resting on the floor. The axle hub has a vertical axle hole to allow a screw post fastened to the bottom of a stool to run through. The axle hub has a hinge portion on one side of the top surface thereof. The hinge portion has first lugs on the left side and right side to be coupled respectively with one end of a clamping member. The clamping member has another end to be fastened transversely by a fastening element. The hinge portion and the two clamping members have respectively a thread portion corresponding to the screw post. Thereby the elevation of the stool can be adjusted rapidly and the screw post beneath the stool can be clamped securely.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
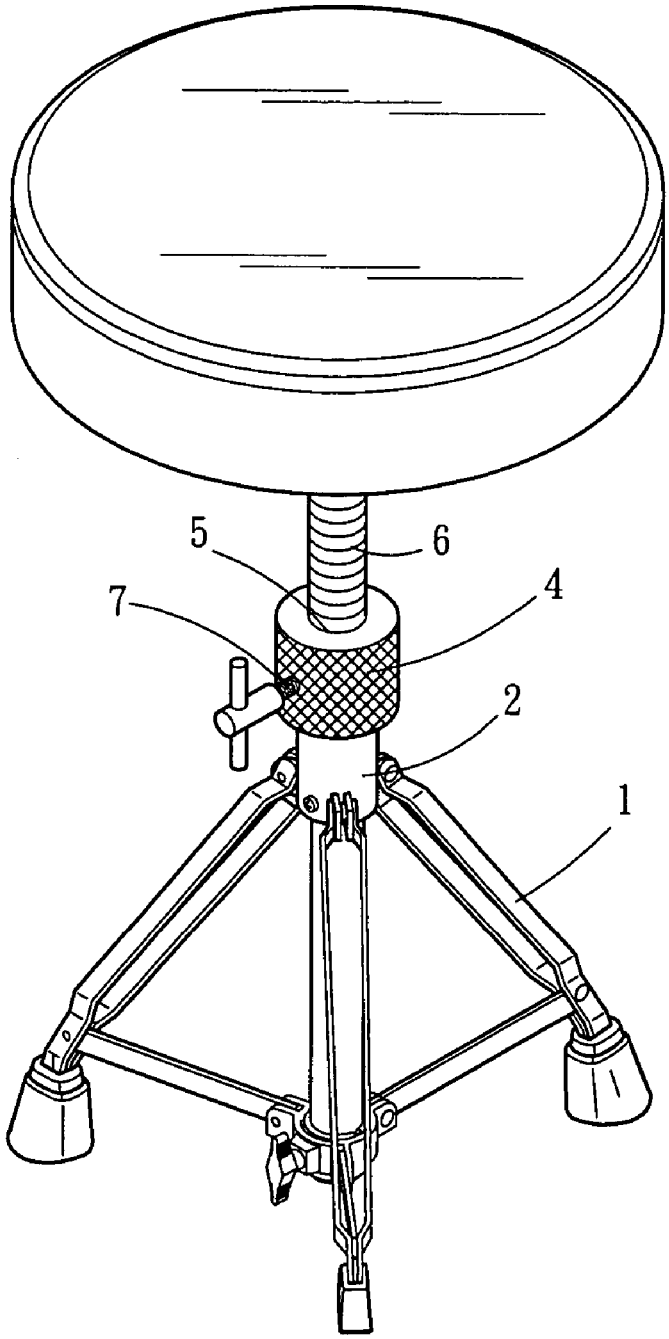
Fig. 1 PRIOR ART
FIG. 1 is a perspective view of a conventional musical stool.
Figure 2:
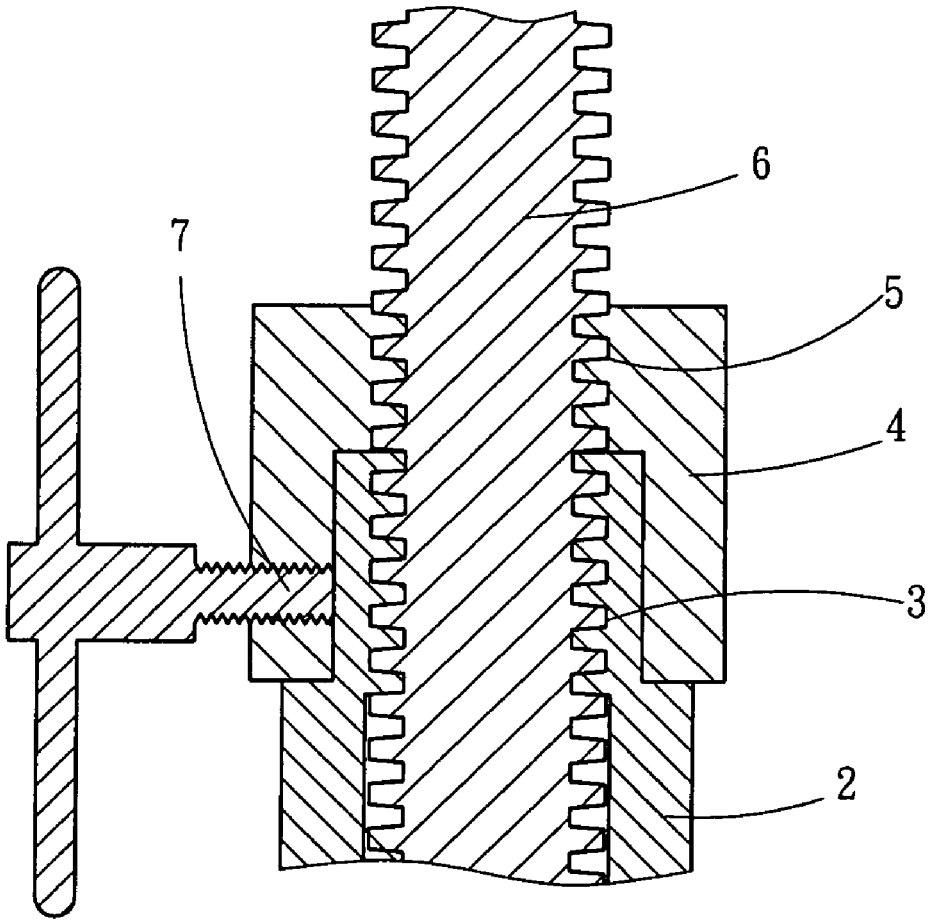
Fig. 2 PRIOR ART
FIG. 2 is a fragmentary sectional view of a conventional musical stool.
Figure 3:
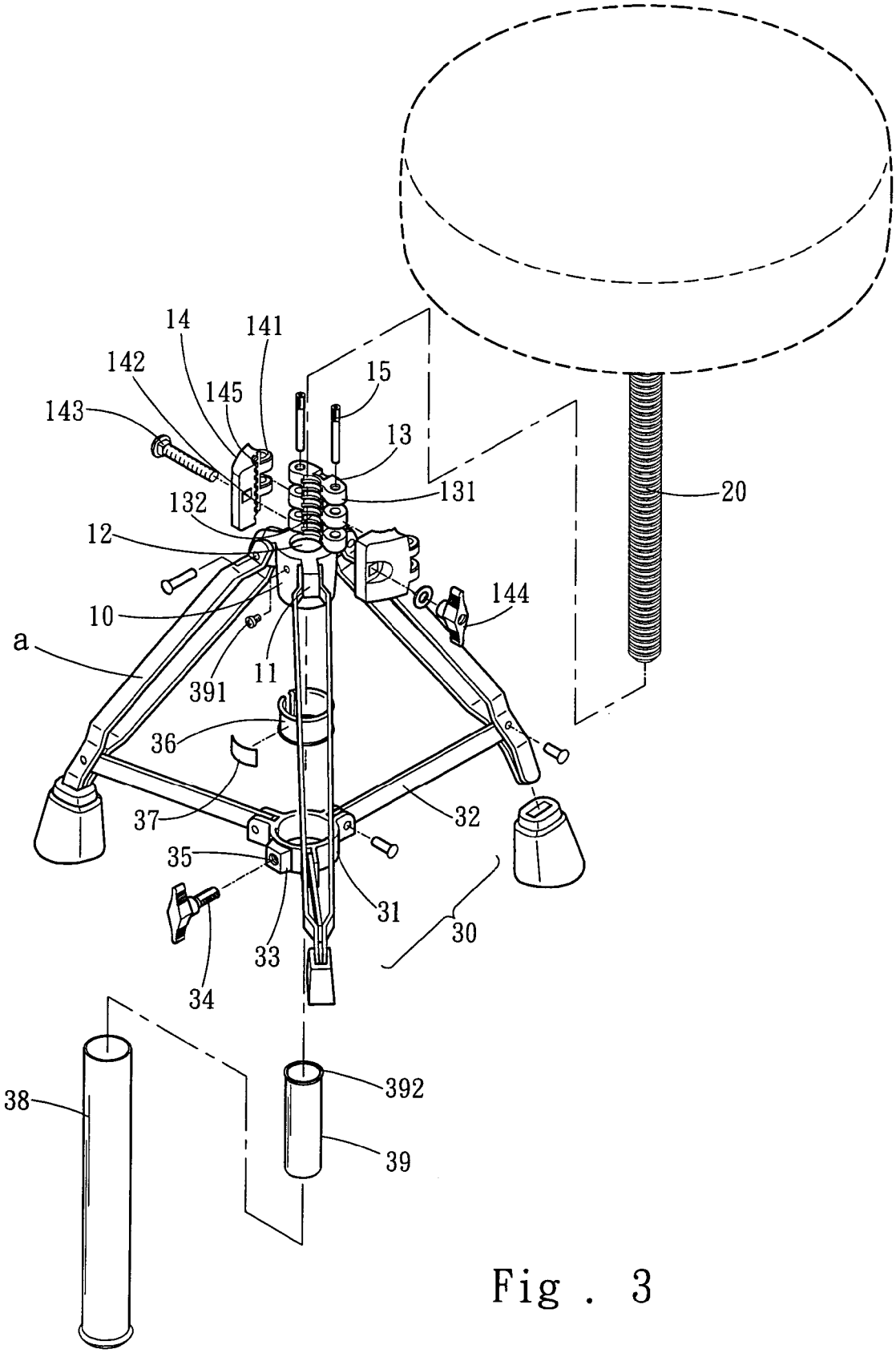
FIG. 3 is an exploded view of an embodiment of the present invention.
Figure 4:
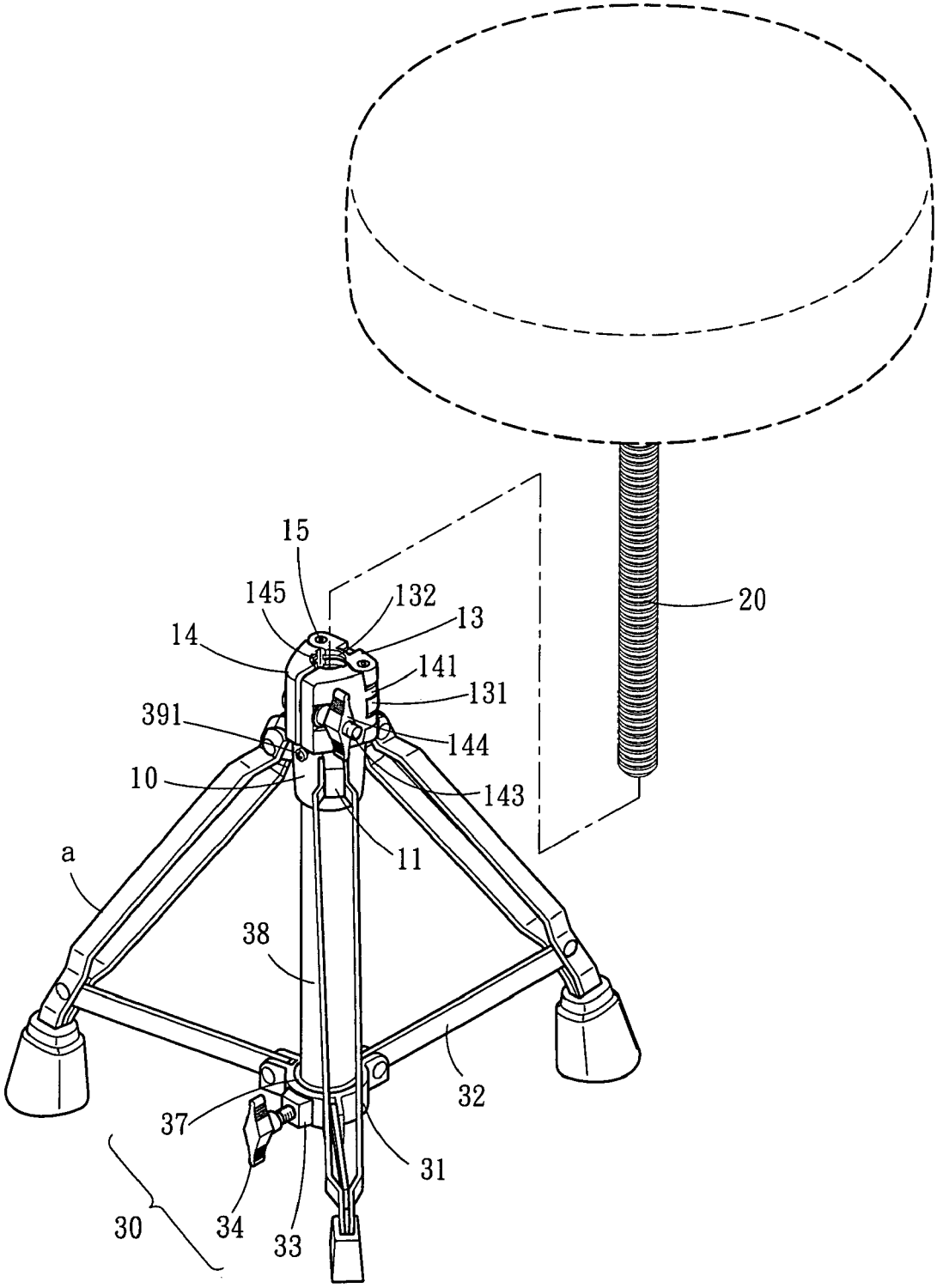
FIG. 4 is another exploded view of an embodiment of the present invention.

Please refer to FIGS. 3 and 4, the anchoring fixture for stools capable of adjusting elevation according to the invention is installed on tripod legs a resting on the floor. The tripod legs a are jointly hinged on an axle hub 10 on the top ends thereof. The axle hub 10 is substantially a circular barrel with three first lugs 11 located on the peripheral wall in an equally spaced manner to be hinged with the top end of the tripod legs a. The axle hub 10 has a longitudinal and round axle hole 12 in the center and a hinge portion 13 on one side of the top surface thereof. The hinge portion 13 has three second lugs 131 on the left side and the right side, and an inner wall which has an arched first thread portion 132 directing inwards. The second lugs 131 are hinged with two clamping members 14 that are formed respectively in a plate fashion. Each of the clamping members 14 has two rotary lugs 141 on one side to be coupled with the spaced second lugs 131 of the hinge portion 13 through a longitudinal pin 15 so that the clamping members 14 can be swiveled (also referring to FIG. 6). The clamping member 14 has a transverse aperture 142 on another side (also referring to FIG. 5) to be coupled with a fastening element 143 (such as a bolt) which is fastened to a nut 144. The clamping members 14 have an inner wall which has a second thread portion 145 directing inwards and mating the first thread portion 132 of the hinge portion 13 to jointly form an annular thread portion.

A screw post 20 is provided which has the top end fastened to the bottom of a stool. The screw post 20 runs through the axle hole 12 longitudinally. The annular thread portion jointly formed by the thread portions 132 and 145 of the hinge portion 13 and the two clamping members 14 mates the screw post 20 so that the screw post 20 may be coupled and rotated.

A pressing unit 30 is provided which has an annular ring 31. The annular ring 31 has an outer wall to hinge three connection bars 32 that are equally spaced from one another. The connection bars 32 have one end pivotally coupled with a lower side of each tripod leg a. The outer wall of the annular ring 31 further has a bulged rectangular slug 33 which has a screw hole 35 to be coupled with a pressing element 34 (such as a bolt). The interior of the annular ring 31 is coupled with a pliable contracting ring 36 made from plastics. The contracting ring 36 has an arched outer wall attached to a pad 37 with a mating arched shape. The pad 37 is compressed by a distal end of the pressing element 34. There is a hollow guarding tube 38 running through the contracting ring 36. Through the compression of the pressing element 34 and the pad 37, the contracting ring 36 is contracted inwards to hold the guarding tube 38 on a lower side of the axle hub 10. The top end of the guarding tube 38 holds a sleeve 39 which has an upper portion inserted into the axle hub 10. A screw 391 runs transversely through the outer wall of the axle hub 10 with a distal end pressing the bottom side of a bulged ring 392 formed on the top peripheral rim of the sleeve 39 for anchoring. The guarding tube 38 aims to surround the screw post 20.

Figure 5:
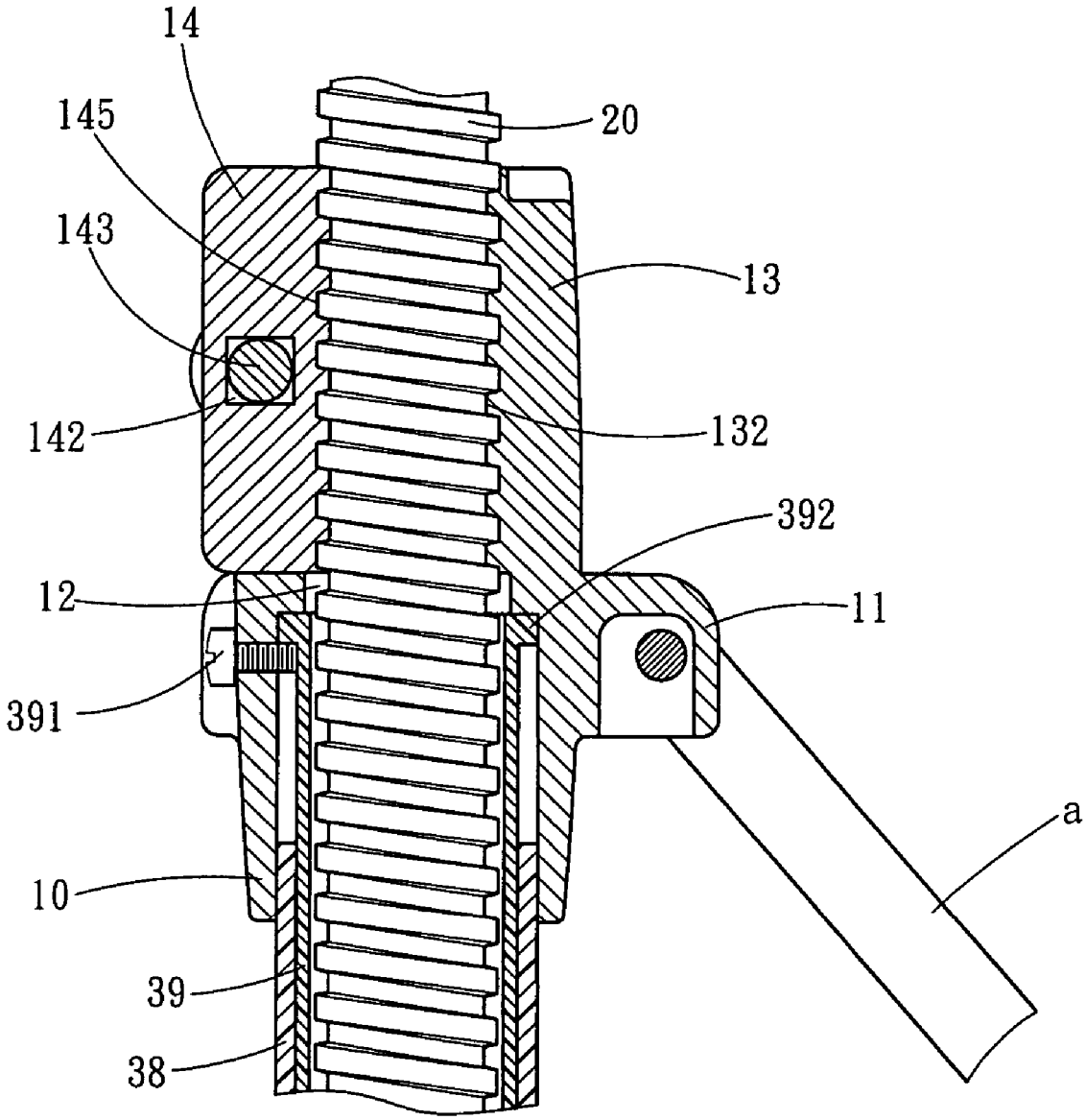
FIG. 5 is a fragmentary longitudinal cross section of an embodiment of the present invention.
Figure 6:
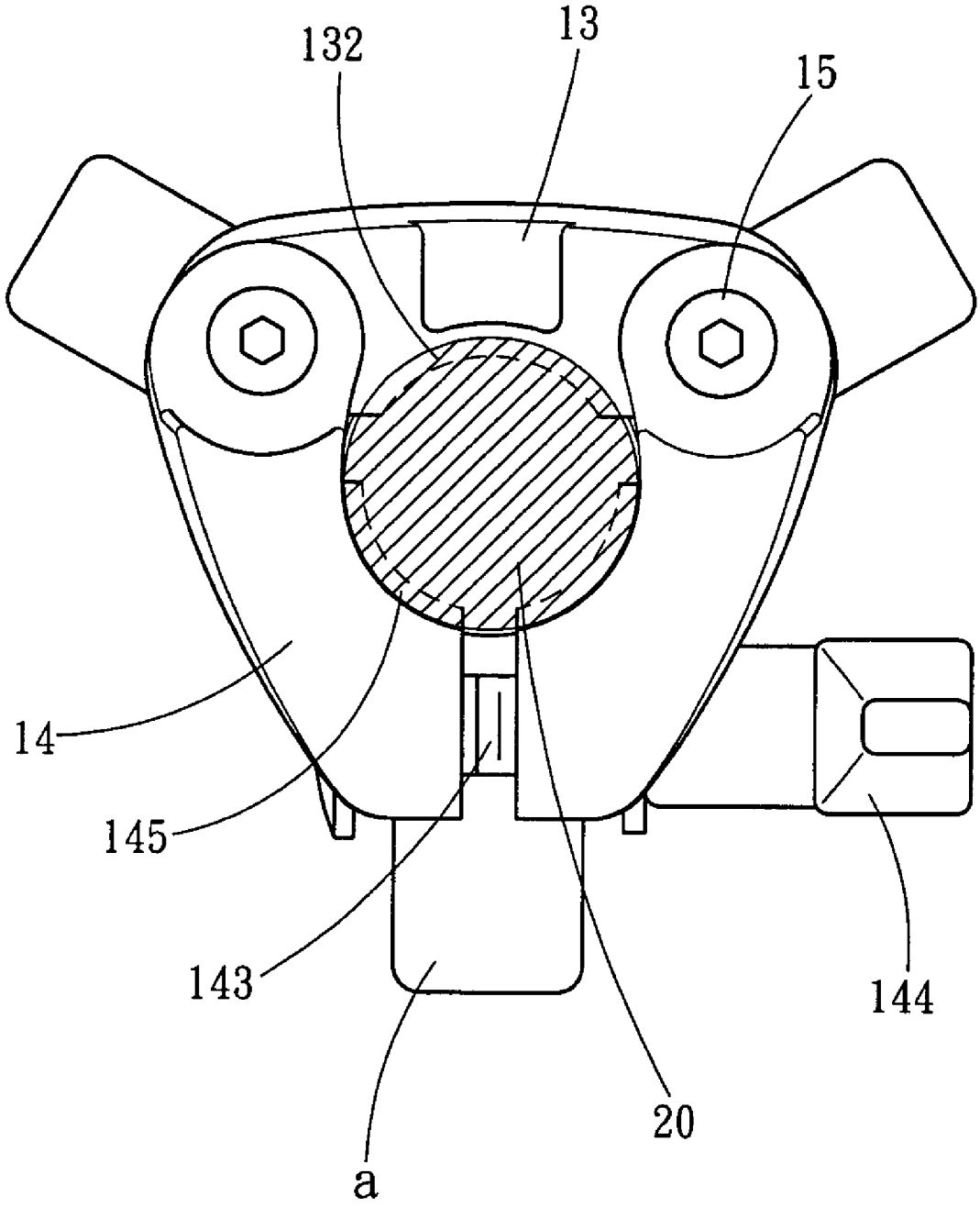
FIG. 6 is a fragmentary transverse cross section of an embodiment of the present invention.

By means of the construction set forth above, referring to FIGS. 5 and 6, when in use for adjusting the elevation of the stool quickly, first, loosen the nut 144 coupled on the fastening element 143; next, retract the fastening element 143 from one side to enable the two clamping members 14 to be swiveled outwards so that the thread second thread portion 145 is moved away from the screw post 20, and the screw post 20 can be rapidly moved upwards or downwards to reach a desired elevation; fasten the nut 144 on the fastening element 143 again to move the two clamping members 14 to clamp the screw post 20 at the same time; the clamping members 14 and the first thread portion 132 of the hinge portion 13 jointly and tightly clamp the screw post 20 with three arched inner walls so that people can sit on the stool securely and turn without rotating the screw post 20.

In the event that there is a desire to fine tune the elevation of the screw post 20, loosen the nut 144 to slightly unfasten the two clamping members 14, the screw post 20 can be rotated upwards or downwards until reaching the desired elevation. Then fasten the nut 144 again to tightly clamp and anchor the screw post 20 with the three arched inner walls of the two clamping members 14 and the hinge portion 13.

In summary, the sample made according to invention has been tested with a desired result. It provides a significant improvement over the conventional products now on the market.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An anchoring fixture for a stool which has an adjustable elevation to be installed on a top end of a plurality of legs located beneath the stool, comprising an axle hub hinged on the top end of the legs, the axle hub having a longitudinal axle hole to allow a screw post fastened to the bottom of the stool to run through and a hinge portion vertically located on one side of a top surface thereof, the hinge portion having a lug on each of two sides to hinge one end of clamping members, the clamping members having another end to be run through transversely and fastened by a fastening element, the hinge portion and the two clamping members having respectively a thread portion which is jointly coupled to mate and couple with the screw post beneath the stool.

2. The anchoring fixture of claim 1, wherein the axle hub has a pressing unit on a lower side thereof, the pressing unit including an annular ring which has a peripheral wall pivotally coupled with three connection bars in an equally spaced manner, the connection bars having another end pivotally coupled with a lower side of the legs, the annular ring having a bulged wall slug on the peripheral wall to be transversely coupled with a pressing element, the annular ring housing a pliable contracting ring, the pressing element having a distal end compressing the contracting ring, the contracting ring housing a hollow guarding tube which surrounds the screw post.

3. The anchoring fixture of claim 2, wherein the pressing element is a bolt, the contracting ring having an arched pad attached on the peripheral wall thereof mating the curvature of the contracting ring to be compressed by a distal end of the bolt.

4. The anchoring fixture of claim 2, wherein the guarding tube holds a sleeve on a top portion thereof, the sleeve having an upper portion running through the interior of the axle hub, the outer wall of the axle hub being run through by a screw which has a distal end compressing the bottom of a bulged ring formed on a peripheral top rim of the sleeve.

5. The anchoring fixture of claim 1, wherein the hinge portion has three second lugs on each of two sides, the clamping members having two rotary lugs to be coupled with the second lugs through a longitudinal pin.

6. The anchoring fixture of claim 1, wherein the fastening element is a bolt, the two clamping members having an aperture on another end running through by the bolt which has a distal end coupled with a nut for fastening.

* * * * *